US007597794B2

(12) United States Patent
Zhao et al.

(10) Patent No.: US 7,597,794 B2
(45) Date of Patent: Oct. 6, 2009

(54) DEEP SEPARATION METHOD AND PROCESSING SYSTEM FOR THE SEPARATION OF HEAVY OIL THROUGH GRANULATION OF COUPLED POST-EXTRACTION ASPHALT RESIDUE

(75) Inventors: Suoqi Zhao, Beijing (CN); Chunming Xu, Beijing (CN); Ren'an Wang, Beijing (CN); Zhiming Xu, Beijing (CN); Xuewen Sun, Beijing (CN); Keng H. Chung, Beijing (CN)

(73) Assignee: China University of Petroleum-Beijing

( * ) Notice: Subject to any disclaimer, the term of this patent is extended or adjusted under 35 U.S.C. 154(b) by 219 days.

(21) Appl. No.: 11/265,468

(22) Filed: Nov. 1, 2005

(65) Prior Publication Data

US 2007/0007168 A1 Jan. 11, 2007

(30) Foreign Application Priority Data

Jul. 5, 2005 (CN) ..... 2005 1 0080799

(51) Int. Cl.

| | |
|---|---|
| ***C10C 1/18*** | (2006.01) |
| ***C10C 3/08*** | (2006.01) |
| ***B01J 8/04*** | (2006.01) |
| ***B01J 10/00*** | (2006.01) |

(52) U.S. Cl. ..... 208/45; 208/251 R; 208/309; 208/312; 422/188; 422/198

(58) Field of Classification Search ..... 208/45, 208/309, 251 R, 312; 422/188, 198
See application file for complete search history.

(56) References Cited

U.S. PATENT DOCUMENTS

| | | | | |
|---|---|---|---|---|
| 3,434,967 | A * | 3/1969 | Oldenburg | 208/309 |
| 3,847,751 | A | 11/1974 | Godino et al. | |
| 4,482,453 | A * | 11/1984 | Coombs et al. | 208/309 |

FOREIGN PATENT DOCUMENTS

CN 1167770 C 9/2004

* cited by examiner

*Primary Examiner*—Glenn Caldarola
*Assistant Examiner*—Prem C. Singh
(74) *Attorney, Agent, or Firm*—Yi Li

(57) ABSTRACT

The present invention is a separation method and system in which granulation of coupled post-extraction asphalt residue is used to achieve deep separation of heavy oil. A dispersion solvent is introduced into the asphalt phase after separation by solvent extraction and the asphalt phase undergoes rapid phase change in a gas-solid separator and is dispersed into solid particles while the solvent vaporizes, resulting in low temperature separation of asphalt and solvent with adjustable size of the asphalt particles. The separation method of this invention also includes a three-stage separation of heavy oil feedstock, in which the deasphalted oil phase separated from heavy oil is treated with supercritical solvent and results in the further separation of the resin portion of the deasphalted oil, maximizing the yield and quality of the deasphalted oil. The processes and systems in this invention use atmospheric pressure and a low temperature gas-solid separator instead of a high temperature and high pressure furnace and do not require the feed pre-heating or heat exchange equipment at the inlet of resin separator column, resulting in a simplified process flow and reduced investment.

14 Claims, 1 Drawing Sheet

DEEP SEPARATION METHOD AND PROCESSING SYSTEM FOR THE SEPARATION OF HEAVY OIL THROUGH GRANULATION OF COUPLED POST-EXTRACTION ASPHALT RESIDUE

FIELD OF THE INVENTION

The invention relates to a process and equipment for deep processing of heavy oil in the petroleum industry. More specifically, the invention relates to a deep separation method for heavy oil components using a solvent and separation of the solvent at low temperatures through granulation of coupled post-extraction asphalt residue.

BACKGROUND OF THE INVENTION

Solvent deasphalting is a technique in the petroleum industry to remove a heavy component asphalt from heavy oil, applicable to heavy oil and oil-sand bitumen, and the atmospheric and vacuum residua resulting from the processing of crude oil. The density at 20° C. of these heavy oils is typically greater than 0.934 g/cm$^3$ (API less than 20) or the boiling point is above 350° C. The deasphalted oil after the removal of asphalt is mainly used as the base oil for lubricants or as the feedstock for subsequent processing such as catalytic cracking or hydroprocessing. The asphalt removed can be used for road pavement and construction materials or as fuel.

The solvent used for the deasphalting process for lubricants is normally propane or butane while for catalytic cracking or hydroprocessing feedstock butane or pentane fractions are often used as solvents. The resultant asphalt is mainly used as fuel or the asphalt component for road construction. The existing deasphalting techniques use either a two stage or a three-stage process. In the first stage, the mixture of the solvent and the heavy oil becomes two phases with the light phase being composed of solvent and deasphalted oil (DAO) and the heavy phase being asphalt phase comprising deoiled asphalt and a certain amount of solvent. After discharging from the extractor, the asphalt phase is heated in a heater to a relatively high temperature to flash off most of the solvent and the remaining solvent is further removed by gas stripping, resulting in deoiled asphalt. In the second stage, the DAO phase is heated to close to the critical point of the solvent or supercritical condition to recover most of the solvent. Steam is used to further strip off the remaining solvent to produce DAO. When a three-stage process is applied, DAO is heated to a higher temperature or reduced to a low pressure to lower the dissolving capacity of the solvent so that the heavier fraction of DAO (resin) settles in the second stage separation. The DAO is heated again to a higher temperature or reduced to a lower pressure for third stage recovery of solvent. The resin and the DAO are stripped to further remove the remaining solvents, resulting in the so-called heavy DAO (or resin) and light DAO.

In this traditional three-stage separation process, the quality control of the DAO is achieved by heating the DAO phase to a higher temperature with a heat exchanger so that the resin in the DAO will settle in the second stage of separation. The separation efficiency is only one equilibrium stage and could not achieve good DAO quality with high yield from heavier feedstock. In order to achieve even such performance, the feeding of the separation column for the resin in the three-stage separation process still needs a complicated heat exchange system.

Based on existing solvent deasphalting processes in either two-stage or three-stage methods, the heating of the asphalt phase is a key factor restricting the yield of the DAO. In order to obtain higher yield of DAO, heavier solvents (such as pentane or hexane) are generally used. However, the softening point of the resultant asphalt will also be higher, which means that the asphalt must be heated to a higher temperature to remove solvent. Under such high temperatures (much higher than the softening point), asphalt undergoes chemical decomposition and condensation, which leads to formation of coke and carbonaceous materials. Besides, asphalt of high softening point (greater than 100° C., especially greater than 150° C.) is highly viscous even at high temperatures, which makes it difficult for discharge and transportation. Therefore, the existing solvent deasphalting processes can not meet the requirements of deep separation of heavy oil.

U.S. Pat. No. 3,847,751 discloses a process for separation of the asphalt phase of a high asphalt content feedstock by heating the asphalt phase to 287-371° C. to remove the solvent and then form granules. Therefore, the problem of heating the asphalt phase using a heater is still not effectively solved.

Chinese patent ZL 01141462.6 "A separation process and its equipment for the removal of asphalt with high softening point in petroleum residua." discloses a method for the separation of asphalt. In this method, the asphalt phase after solvent extraction was sprayed under throtting and rapid expansion to form asphalt particles with a high softening point. The remaining solvent becomes gaseous after expansion and thus separates from the asphalt particles in a low temperature gas-solid separation process. The advantage of this process is that the recovery of the solvent in the asphalt phase does not require the traditional method of heating with a furnace or flash stripping, which involves a high investment, so that the process scheme is simplified and construction investment is reduced. There are two products from the method given by this patent, i.e., deoiled asphalt particles and DAO. However, there are also limitations with this method. On one hand, while the method is capable of separating solvent from asphalt at a low temperature, the result of the dispersion and granulation of asphalt is controlled by the property of the asphalt phase after extraction and the operational conditions of the extraction column and there are no independent operating parameters to control the size of the asphalt particle, which could even affect the operation of the process. On the other hand, this patent has not effectively addressed the issue with "heavier" feedstocks or the adjustment of relatively poor DAO quality. Therefore, there are some constraints with its application.

SUMMARY OF THE INVENTION

The present invention provides a deep separation method for heavy oil using coupled post extraction residue and low temperature separation of solvent with higher yield of DAO and without requiring high temperature heating. This method simplifies the processes and is capable of deep separation of "heavier" heavy oil feedstocks, providing a wide range of improved feedstocks for processes of upgrading of heavy oil, such as catalytic cracking or hydroprocessing.

This invention provides a deep separation method for heavy oil by coupled post-extraction asphalt residue granulation, including the following processes:

1) mixing heavy oil with an extraction solvent to separate the asphalt phase and DAO phase by extraction;

2) dispersing the solvent added to the asphalt phase from the extraction step so that the asphalt phase is subjected to a gas-solid separation process under dispersion conditions. The asphalt is dispersed into solid particles while the solvent becomes gaseous and is recovered by condensation. The mass flow ratio of the dispersing solvent to the asphalt phase is approximately 0.01-0.5:1. In this process, the gas-solid separation occurs at a temperature that is higher than the boiling point of the solvent but lower than the softening point of the asphalt. The softening point of the asphalt is above approximately 100° C., preferably above approximately 150° C.

In accordance with the invention, it has been discovered that the dispersing solvent can be introduced into the asphalt phase after extraction. The asphalt phase and the dispersing solvent are mixed and undergo rapid phase change in a gas-solid separator and the asphalt phase is dispersed into solid particles. In this case, a low temperature, atmospheric gas-solid separator is used to replace a high temperature and high pressure asphalt heating furnace. Since the asphalt phase is forced into particles by gas-solid separation under dispersion, the size of the asphalt particles can be adjusted by controlling the conditions and the amount of the dispersing solvent, which leads to coupled post-extraction asphalt residue granulation. In this invention, the dispersing solvent that leads to the enhanced dispersion of the asphalt phase is called "enhanced dispersing solvent." Theoretically, there is no particular limit to the selection of the enhanced dispersing solvent as long as it can achieve the desired dispersion result, i.e., it can be the same solvent as the extraction solvent or it can be different from the extraction solvent. In actual production, for the convenience of operation, the preferred dispersing solvent would be the same as the extracting solvent used in the separation system.

According to the scheme of the current invention, the temperature of the extraction column can be controlled at approximately between 80° C. and 250° C. with a pressure range of approximately 3-10 MPa. Upon entering the extraction column, the mass flow ratio of the extraction solvent (called the primary solvent) to the feedstock is approximately 1.5-5:1 (defined as the primary solvent ratio). The asphalt phase is then separated. The extraction solvent (called the secondary solvent) is again added to the asphalt phase from the bottom of the extraction column for further extraction. The mass flow ratio of the secondary solvent to the feedstock is approximately 0.2-2:1 (defined as the secondary solvent ratio). After the extraction is completed, the asphalt phase is discharged from the bottom of the column.

The primary composition of the extraction solvent used in the entire separation system is C4-C6 alkane while the composition of the solvent can contain isobutane, butane, pentane, isopentane and hexane with the preferred pseudo critical temperature Tc of the solvent fractions applicable to this invention being approximately between 120° C. and 240° C. The above pseudo critical temperature Tc is calculated using the equation $$Tc = \sum_{i=1}^{n} x_i Tc_i,$$

where $x_i$ is the molar fraction of solvent component i, $Tc_i$ is its critical temperature in Celsius and n is the number of components contained in the solvent.

The separation method of this invention can be a two-stage process. The asphalt phase is separated and asphalt is dispersed into the required sizes of particles and at the same time, a DAO phase is obtained. For "super heavy" heavy oil, a third stage can be employed to further separate the DAO into light DAO and resin (also called heavier DAO) so that the properties of the DAO may be improved and the yield of light DAO can be maximized. Therefore, the deep separation method for heavy oil of this invention also includes the following: the DAO phase separated by the solvent extraction of process 1) is first mixed with supercritical solvent and comes into contact with a resin-free oil phase flowing in a countercurrent direction. The heavier resin is separated from the DAO phase, giving rise to light DAO. The obtained light DAO is heated so that the solvent in the oil is in a supercritical state, resulting in the separation of the solvent from the light DAO. The ratio of mass flow of the supercritical solvent mixed with the DAO to the total mass flow of the DAO is equal to 0.01-0.5:1 and the ratio of the mass flow of the resin-free oil phase to the total mass flow of the DAO is equal to 0.01-0.5:1.

The supercritical solvent mixed with the DAO in this invention is usually the same as the extraction solvent used and circulating in the separation system and the resin-free oil phase can be the direct use of the light DAO separated by the supercritical solvent recovery in the system. According to the scheme of this invention, the DAO phase from the extraction column is mixed directly with an appropriate amount of supercritical solvent to an adequate separation temperature. The mixture is then passed through a resin separator and comes into contact with light DAO flow in a countercurrent direction, especially the light DAO of higher temperature from the circulation portion of the recovery column of the supercritical solvent, resulting in effective separation of resin, preferably, with the light DAO entering the separation column from the top, thus creating a temperature gradient by the transfer of materials and heat. This is favorable for improving the separation selectivity of the resin and the DAO. The light phase from the top of the resin separation column is heated to a supercritical state and enters the solvent recovery column resulting in the effective separation of light DAO and solvent at relatively low solvent density. The recovery condition for supercritical solvent is that the density of the solvent is lower than approximately 0.2 g/cm$^3$, with more than 80% of the circulating solvent being recovered from the column and returned to the extraction column under high pressure.

Whether a two-stage or a three-stage process is employed for the separation method of this invention, it is possible to carry out further actions on the remaining small amount of solvent in the DAO and the resin, such as pressure reduction, heating, stripping, cooling and recovery.

Compared with the traditional solvent deasphalting of heavy oil, the separation method of the current invention utilizes alkanes with relatively high carbon atom number (C4, C5, C6 alkane or their mixture) as a solvent and has liquid yields, i.e., the total amount of DAO and resin for different heavy oils as high as 100% minus the weight percent of C7 asphaltene in the feedstock. The yield and quality of DAO can be flexibly controlled and the DAO and resin can be used as feedstocks for catalytic cracking or hydroprocessing. A low temperature and atmospheric gas-solid separator is used in place of a high temperature and high pressure system and the heating or heat exchange equipment for the feeding of the resin separation column is eliminated, resulting in a simplified process flow scheme and reduced investment. By adjusting the size of the solid asphalt particles, the asphalt particles can be directly transported or used as a feedstock for the manufacturing of synthetic gases or hydrogen, emulsification fuel or directly used as solid fuel. The current invention can be widely used in the field of deep processing of heavy oil in the petroleum industry and for changing the characteristics of heavy oil production.

The second aspect of this invention is that it provides a separation system for the implementation of coupled post-extraction asphalt residue granulation and deep separation of heavy oil with low temperature solvents.

The separation system provided by this invention includes a feedstock mixer, an extraction column, a mixer for DAO, a heater, an atmospheric gas-solid separator, a solvent tank, a recovery column for supercritical solvent, and a stripping column for DAO, a stripping column for resin, wherein:

a feedstock mixer is connected to the extraction column and the solvent tank is connected with the mixer through a transfer line; after mixing in the mixer, the solvent and the heavy oil feedstock are fed into the extraction column and are separated as an asphalt phase and a DAO phase; at the lower part of the extraction column is a solvent inlet from which solvent can be introduced into the asphalt phase at the column bottom for further extraction;

the asphalt outlet at the bottom of the extraction column being connected to an atmospheric gas-solid separator with an inlet for enhanced dispersing solvent and a discharge outlet for asphalt particles on the connecting transfer line and an outlet for vaporized solvent connected to the solvent tank; the asphalt phase and enhanced dispersing solvent being mixed and introduced into the gas-solid separator for rapid phase change with asphalt being dispersed into solid particles and the solvent vaporized as gas and returned to the solvent tank via a transfer line, resulting in solvent-free asphalt particles of high softening point;

an outlet for DAO at the upper part of the extraction column being connected to a solvent recovery column through a heater, such that when DAO enters the supercritical solvent recovery column via the heater, the solvent can be separated from the DAO under supercritical conditions;

the outlet at the lower part of the supercritical solvent recovery column being connected to the stripping column of DAO with a solvent outlet connected to solvent tank, resin and DAO with a small amount of solvent entering the DAO stripping column from the lower outlet; the stripping column being fitted with a DAO or resin discharge outlet and a solvent discharge outlet with the latter connected to the solvent loop of the system; and the extraction solvent forms a circulating loop in the system with the recovered solvent being returned to the solvent tank (high pressure solvent tank and low pressure solvent tank can be designed in the loop) and circulation being completed with the help of a solvent pump; with solvent being added to the system whenever it is needed.

In case a three-stage separation is desired, the separation system of the present invention can also include a mixer for DAO, a resin separator (or resin separation column) and a resin stripping column, i.e., adding a resin separation system between the extraction column and the heater, as follows:

the outlet for the DAO phase at the upper part of the extraction column is connected to a DAO mixer and the outlet of the DAO mixer is connected to a resin separator; on the DAO mixer, there is an inlet for supercritical solvent that is connected with the supercritical solvent recovery column; the DAO and supercritical solvent being mixed in the mixer and then introduced into the resin separator where the resin phase is separated from the light DAO phase;

the resin separator having an inlet for resin-free light DAO phase at the top which is connected to the oil phase outlet of the supercritical solvent recovery column via a pump so that the oil phase from the bottom of supercritical solvent recovery column enters the resin separator from the top and comes into contact with the mixture from the DAO mixer in countercurrent flow with the outlet of the resin separator for the DAO phase and the solvent mixture being connected to the heater;

the lower part of the resin separator being connected to the resin stripping column which has a solvent outlet connecting to the solvent recovery pipeline with a cooler in the transfer line; the resin from resin separator entering the resin stripping column; wherein after separating the solvent gas, the resin is discharged from the resin outlet.

The separation system of this invention and the specific equipment, such as the atmospheric gas-solid separator, various separation, extraction and supercritical solvent recovery columns are all routine equipment in the art. The innovation of this invention lies in the appropriate connection and combination of this routine equipment and operating this routine equipment under appropriate conditions according to the requirements of the processes which form the entire system for this invention.

It can be seen from the above discussion that in order to obtain higher yields of DAO and resin, light alkanes with a higher number of carbon atoms (C4, C5, C6 and their mixtures) are used as solvents, which will necessarily lead to higher softening points of deoiled asphalt which also makes it difficult to recover the solvent using traditional heating with heaters and flash and steam stripping. The present invention employs an enhanced rapid phase change method of the asphalt phase and disperses asphalt residue of high softening point into solid particles and achieves the separation of asphalt from solvent with an atmospheric gas-solid separator. This method eliminates the use of heating devices and the issues associated with the heating of asphalt in traditional processes. Furthermore, this method introduces the process of coupled post-extraction asphalt residue granulation and is capable of processing heavier or poor quality feedstock. It not only provides more feedstock for density reduction of heavy oil but also saves investment for the construction of the processing plant.

In summary, the separation method of this invention is an improvement of prior techniques. By introducing an enhanced dispersing solvent, the present invention is capable of independently adjusting and controlling the dispersion and granulation of post-extraction asphalt phases and the size of the solid asphalt particles can be adjusted; furthermore, in the three-stage separation process of the traditional solvent deasphalting, the control of DAO quality is by heating the DAO phase through a heat exchanger and settling the resin in DAO in the secondary separation process with a separation efficiency of only one equilibrium stage. So the traditional methods are not very effective in improving the poor quality DAO from heavier feedstock. This invention addresses separation efficiency in two ways: first, direct mixing and heating of DAO and supercritical solvent, and second, circulating light DAO of relatively higher temperature at the lower part of the supercritical solvent recovery column to the top of the resin separation column. The temperature gradient from bottom to top established by the transfer of heat and materials in the resin separation column improves the separation selectivity of DAO and resin. Therefore, the implementation of this invention eliminates the complicated heat exchange system for feeding the resin separation column in traditional three-stage separation processes.

DETAILED DESCRIPTION OF THE PREFERRED EMBODIMENTS

Figure 1:
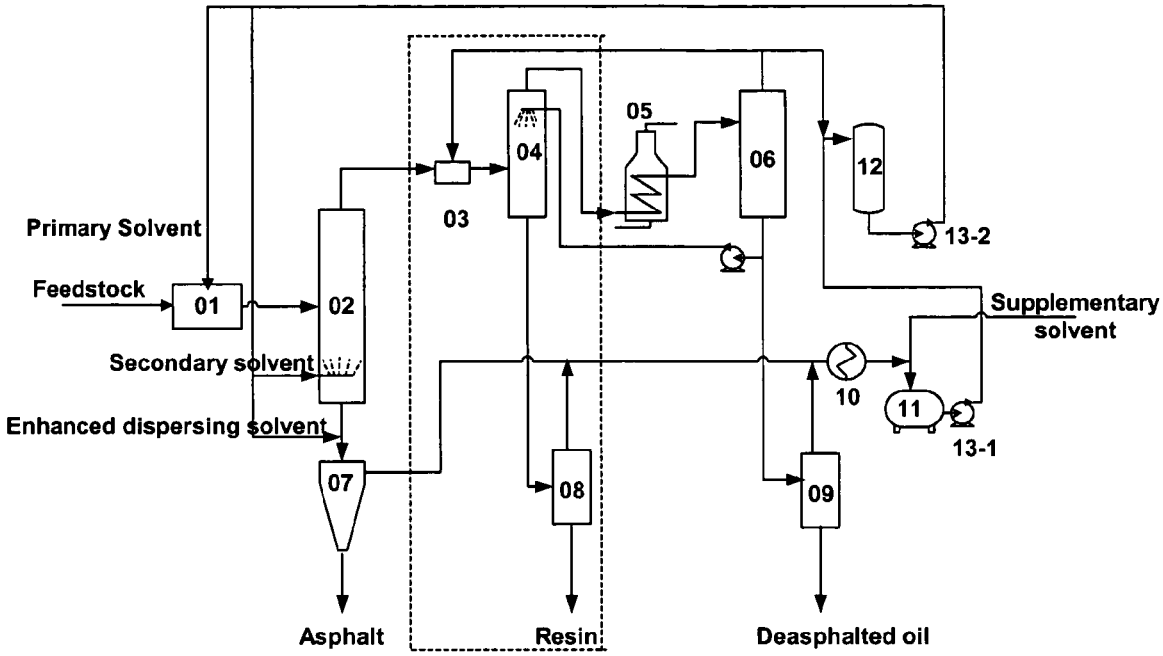
FIG. 1 is a flowsheet of the process and equipment of the preferred embodiment of the present invention.

The following are more detailed discussions of the current inventions in association of the figures and the actual schemes of the embodiments.

The solvents used in this invention are mostly C4, C5 and C6 alkanes or their mixtures, which can contain butane, pentane, hexane and their isomers with the required pseudo critical temperature being in the range of 120-240° C. Pseudo critical temperature Tc is calculated using the equation $$Tc = \sum_{i=1}^{n} x_i Tc_i,$$

where $x_i$ is the molar fraction of solvent component i, $Tc_i$ is its critical temperature in Celsius and n is the number of components contained in the solvent. The technical processes are as follows.

First, the solvent (primary solvent) is mixed with the feed heavy oil in certain proportion in feedstock mixer 01 with the ratio of the primary solvent to the feedstock in mass flow being approximately 1.5-5:1. The mixture enters extraction column 02 and is separated into a DAO phase and an asphalt phase. The extraction column 02 operates at approximately 80-250° C. and 3-10 MPa.

Then, the DAO phase is separated from the top of extraction column 02 and the asphalt phase is again in full contact with the solvent (secondary solvent) introduced from the bottom of the extraction column. The mass flow ratio of the secondary solvent to the feedstock is approximately 0.2-2:1. The secondary solvent further dissolves and extracts the residual fraction of oil in the asphalt, giving rise to asphalt with a relatively higher softening point (greater than 100° C., preferably greater than 150° C.). The asphalt phase separated from extraction column 02 is mixed with an enhanced dispersing solvent and the mixture enters the gas-solid separator for rapid phase change separation with the temperature of the solvent and the asphalt decreased to the range between the boiling point of the solvent and the softening point of the asphalt. The solvent becomes gaseous and asphalt of high softening point is dispersed into solid asphalt particles with the diameter of the asphalt particles within a range of 1-600 μm. The residual solvent in the solid asphalt particles is less than 0.35 wt % of the mass of solid asphalt particles. By adjusting the mixing of the enhanced dispersing solvent, the average diameter of the solid asphalt particles can be flexibly adjusted with good flowability of the solid asphalt particles and can be discharged from the bottom of gas-solid separator 07. The solid asphalt particles can be used as solid fuel and can also be made into particles with an average diameter of less than 100 μm and used in emulsification fuel in water. The solvent gas is separated from the top of the gas-solid separator 07 and is condensed by cooler 10 and returned to the low pressure solvent tank for re-use.

For heavy feedstock, such as oil-sand bitumen or super-heavy oils, the DAO from extraction column 02 can be further separated into light DAO and resin in order to improve the properties of the DAO and to obtain the maximum yield of light DAO. In such a case, a three-stage separation process can be employed. The DAO phase is mixed in DAO mixer 03 with supercritical solvent from supercritical solvent recovery column 06 and heated to raise the temperature. The mixture then enters the middle part of resin separation column 04. The light DAO phase from the bottom of the supercritical solvent recovery column 06 is sprayed from the top of the resin separation column 04, which establishes a temperature gradient with the temperature increasing from the bottom to the top in the resin separation column. The resin is effectively separated and removed from the bottom of the resin separation column with light DAO being separated from the top of the column. The light DAO is heated in heater 05 and enters supercritical solvent recovery column 06 so that the density of the solvent in the recovery column is lower than 0.2 g/cm-.sup.$^3$, thus incapable of dissolving oil. The solvent is separated from the DAO and returned through high pressure solvent tank 12 under high pressure to feedstock mixer 01 and extraction column 02. The remaining small amount of solvent in resin and DAO is recovered by pressure reduction and heating in resin stripping column 08 and DAO stripping column 09, respectively.

If only DAO product is desired (the resin component does not need to be separated out), a two-stage separation process can be employed, i.e., the DAO phase from extraction column 02 can enter heater 05 directly without going through the resin separation system as shown in the dashed box in FIG. 1.

As can be seen from FIG. 1, whether a two-stage system or three-stage system is used, circulation of the solvent for extraction is achieved in the separation system of the current invention. It has been determined that more than 80% of the solvent used is recovered under the high pressure and high temperature supercritical solvent recovery system. The remaining of the solvent used is recovered by the stripping of DAO and/or resin. Only a small amount of solvent loss is carried away by the high softening point asphalt particles (less than 0.35% of the mass of the asphalt particles). In addition, the supercritical solvent and the light DAO of the system are used as the heat source for resin separation in the invention, resulting in the circulation and re-use of thermal energy.

The deoiled asphalt has undesirable properties. In deoiled asphalt, the principal components are asphaltene and heavy resin plus some heavy aromatic hydrocarbons with a high content of heteroatoms. These are detrimental factors affecting the density reduction and viscosity reduction of heavy oil and is the source for catalyst poisoning of the catalytic reaction of heavy oil processing. Asphaltene, resin and heavy aromatic hydrocarbons usually have large molecular weight (2-7 times that of heavy oil) and high density, low H/C atomic ratio (1.16-1.39), and high carbon residues (25.8%-54.6%). Heavy metals Ni and V account for 60%-80%, S for 25%-40% and N for 25%-50% of the total mass in heavy oils. The method of this invention can greatly improve the properties of heavy oil feedstocks by removing those contaminants. The total yield for different types of DAO and resin from various types of heavy oil can be as high as 100% minus the weight percent of C7 asphaltene in the feedstock and the yield and quality of the DAO and resin can be flexibly adjusted and controlled by the temperature and pressure of the resin separation column 04. The DAO and resin can be used as the feedstock for catalytic cracking of hydroprocessing. Therefore, the method of this invention plays an important role in improving the operation of catalytic cracking and hydroprocessing, reducing catalyst poisoning and coking, improving the upgrading processing of oil and the quality of product, and alleviating the difficulty of refining light oil products. Compared with the existing deasphalting techniques, the method of this invention can selectively remove the undesirable components in heavy oil and obtain solid asphalt particles with high softening points with the size of particles being adjustable. This makes it possible for the asphalt particles to be directly used as solid fuel or as the feedstock of emulsification fuel. All these make the method of this invention very valuable in applications of the petroleum field.

The following are the embodiments of the present invention with the process flow as shown in FIG. 1. The primary solvent and secondary solvent and the enhanced dispersing solvent used in the method are all used in the system by circulation. All the examples shown are for illustrative purposes of showing the benefits brought by the implementation of this invention and should not be construed to limit the scope of the invention in any way.

EXAMPLE 1

Deasphalting of vacuum residue (boiling point higher than 520° C.) from Shengli Oil Field of China was performed with pentane blended as solvent. Two-stage separation was employed and the vacuum residue was separated as DAO and solid asphalt powder.

The composition of the solvent was as follows:

| Components | isobutane | butane | pentane | hexane |
|---|---|---|---|---|
| Composition, mol % | 1.00 | 0.05 | 78.05 | 20.90 |
| Critical Temperature, ° C. | 135.0 | 152.0 | 196.6 | 234.4 |

The pseudo critical temperature for the blended solvent was 191.1° C.

Feedstock (flow rate at 100 kg/h) and the primary solvent (flow rate at 350 kg/h) were mixed in mixer 01 (i.e., primary solvent ratio 3.5) and the mixture entered extraction column 02 for the separation of DAO and the asphalt phase. Secondary solvent with a mass flow ratio of 0.8 was input from the lower part of the extraction column 02 for further extraction of the oil in the asphalt phase to improve the yield of DAO and to increase the softening point of the deoiled asphalt. The extraction column was at 170° C. and 5 MPa.

The asphalt phase from extraction column 02 was mixed with enhanced dispersing solvent and the mixture was introduced into gas-solid separator 07 with a mass flow ratio of solvent to asphalt phase of 0.05:1. At 100° C. and atmospheric pressure conditions, the asphalt and the solvent were separated by rapid phase change. The asphalt was dispersed into solid particles with residual solvent content in the asphalt particles accounting for 0.3% of the mass of the solid asphalt particles as determined by headspace gas chromatography. The asphalt particles were 200 μm in diameter on average. The solvent became gaseous after gas-solid separation and was returned to low pressure solvent tank 11 through a solvent recovery loop.

The DAO phase discharged from the extraction column was heated to a solvent density of 0.19 g/cm$^3$ and entered supercritical solvent recovery column 06 where the solvent and the DAO were separated and 85% of the solvent was recovered. The recovered solvent re-entered the circulation and mixed with heavy oil feedstock and entered the bottom of the extraction column. The DAO with residual solvent was further stripped of solvent in the stripping column 09 to recover the solvent. The recovered solvent was returned to low pressure solvent tank 11 via the cooler 10 for re-use.

The softening point of the asphalt discharged form the bottom of the gas-solid separator 07 was 200° C. and 45 wt % of carbon residue, 46% of Ni and almost all of the C7 asphaltene in the feedstock were removed with the asphalt particles. The DAO yield was 85.2 wt % with significantly improved properties favorable for further processing.

The properties of the feedstock, DAO and the deoiled asphalt particles are as follows:

| | Yield wt % | Carbon residue wt % | Density (20 ° C.) g/cm$^3$ | Softening Point ° C. | C7 Asp. wt % | MW | H/C | Elemental Content N wt % | S wt % | Ni μg/g | V μg/g |
|---|---|---|---|---|---|---|---|---|---|---|---|
| Feedstock | 100 | 16.0 | 0.9724 | 42 | 2.2 | 967 | 1.58 | 0.95 | 3.01 | 55.7 | 5.3 |
| DAO | 85.2 | 11.5 | 0.9590 | liquid[a] | <0.1 | 937 | 1.64 | 0.87 | 2.65 | 36.6 | 3.9 |
| Asphalt | 14.8 | 45.0 | 1.0250 | 200 | 13.7 | 5515 | 1.35 | 1.70 | 5.14 | 172 | 12.8 |

Note:
MW—molecular weight; H/C—Hydrogen-Carbon atomic ratio; a—liquid at room temperature, C7 Asp.—C7 Asphaltene content; the same below.

EXAMPLE 2

Deasphalting of vacuum residue (boiling point>520° C.) from Shengli Oil Field of China was performed with pentane blended as solvent. The compositions of the solvent were the same as in Example 1. A three-stage separation process was employed and the vacuum residue was separated as DAO, resin and solid asphalt powder.

The feedstock (flow rate at 10 kg/h) and the primary solvent (flow rate at 35 kg/h) were mixed in mixer 01 (i.e., primary solvent to oil ratio 3.5:1) and the mixture entered extraction column 02 for the separation of DAO and the asphalt phase. Secondary solvent with a mass flow to oil ratio of 0.8:1 was input from the lower part of the extraction column for further extraction of the oil in the asphalt phase to improve the yield of DAO and the softening point of the deoiled asphalt. The extraction column was at 170° C. and 5 MPa.

The asphalt phase from extraction column 02 was mixed with enhanced dispersing solvent and the mixture was introduced into gas-solid separator 07 with a mass flow ratio of solvent to asphalt being 0.15:1. At atmospheric conditions, the asphalt and the solvent were separated by rapid phase change. The asphalt was dispersed into solid particles with residual solvent content in the asphalt particles accounting for 0.22% of the mass of the asphalt particles. The asphalt particles were 90 μm in diameter on average, of which 65% were less than 90 μm. The particles may be emulsified as slurry fuel by adding water. The gaseous solvent obtained from the gas-solid separation was returned to low pressure solvent tank 11 through a solvent recovery loop.

The DAO phase discharged from the extraction column was mixed in mixer 03 with the supercritical solvent from supercritical solvent recovery column 06 to a higher temperature and then entered resin separation column 04. The ratio of mass flow of supercritical solvent to the total mass flow of the DAO phase was 0.15:1 while the ratio of mass flow of the light DAO phase from the bottom of the supercritical solvent recovery column to the mass flow of the total DAO phase was 0.1:1. The resin phase was separated from the light DAO phase in the resin separation column 04. The DAO phase was heated in heater 05 and entered supercritical solvent recovery column 06 where the solvent density was 0.180 g/cm$^3$. The solvent was separated from the DAO and 85% of the total used solvent was recovered. The recovered solvent re-entered circulation and was mixed with the feedstock of heavy oil and entered the extraction column.

The DAO with residual solvent was further stripped of solvent in the stripping column 09, 08 to recover the solvent. The recovered solvent returned to low pressure solvent tank (11) via the cooler 10 for re-use.

A three-stage process was used in which the yield of the DAO can be adjusted as needed to improve the properties of the DAO. In this case, the yield of the DAO was controlled at 65 wt % with carbon residue of only 6.6 wt %, Ni content of 15.5 μg/g and was free of C7 asphaltene. The yield of the resin separated was 20.2 wt % with a C7 asphaltene content below detection limit, carbon residue of 15 wt % and a Ni content of 51.6 μg/g. The asphalt obtained had a softening point of 200° C. with a 45 wt % of residual carbon and a Ni content of 172 μg/g. 46% of Ni in the feedstock was removed with asphalt. The properties of the feedstock, DAO, resin and the deoiled asphalt particles are as follows:

| | Yield wt % | Carbon residue wt % | Density (20 ° C.) g/cm$^3$ | Softening Point ° C. | C7 Asp. wt % | MW | H/C | Elemental content N wt % | S wt % | Ni μg/g | V μg/g |
|---|---|---|---|---|---|---|---|---|---|---|---|
| Feedstock | 100 | 16.0 | 0.9724 | 42 | 2.2 | 967 | 1.58 | 0.95 | 3.01 | 55.7 | 5.3 |
| DAO | 65.0 | 6.6 | 0.9600 | liquid[a] | 0.0 | 740 | 1.70 | 0.51 | 2.24 | 28.5 | 1.8 |
| Resin | 20.2 | 15.0 | 0.9991 | liquid[a] | <0.1 | 903 | 1.50 | 0.90 | 3.41 | 51.6 | 5.5 |
| Asphalt | 14.8 | 45.0 | 1.0250 | 200 | 13.7 | 5515 | 1.35 | 1.70 | 5.14 | 172 | 12.8 |

EXAMPLE 3

Atmospheric residue from Canadian Athabasca oil sand bitumen with a boiling point over 350° C. and a density of greater than 1.0 g/cm$^3$ at 20° C. was obtained from a commercial oil sand plant. This is a heavy feedstock that is quite difficult to process. A two-stage extraction process was used as in Example 1 with pentane as the solvent. The flow rate of feedstock was 100 kg/h with a primary solvent to oil ratio of 3:1 and a secondary solvent to oil ratio of 0.5:1. The extraction column was at 160 C and 5 MPa. The softening point of the asphalt was 180° C.

The asphalt phase and the enhanced dispersing solvent were mixed with a solvent to asphalt mass flow ratio of 0.02:1. The mixture then entered gas-solid separator 07 and the asphalt and the solvent were separated at atmospheric pressure by rapid phase change. The asphalt particles were 300 μm in average diameter with residual solvent of 0.25 wt % of the mass of the asphalt particles.

The solvent density in the supercritical solvent recovery column was 0.17 g/cm$^3$. More than 80% of total solvent used was separated and recovered. The yield of DAO was 84% and had a 0.3 wt % content of C7 asphaltene (an equivalent to 95% of the C7 asphaltene removal). The removal of Ni and V were 68.5% and 65.6%, respectively. The DAO viscosity was only ⅕ of the feedstock and 61.2% carbon residue of the feedstock was removed, which is favorable for transportation and further deep processing.

The yield and properties of the feedstock and the products are listed in the table below:

| | Yield wt % | Carbon Residue wt % | API | Softening Point ° C. | Viscosity (80° C.) cs | C7 Asp. wt % | Elemental content S wt % | Ni μg/g | V μg/g |
|---|---|---|---|---|---|---|---|---|---|
| Feedstock | 100 | 13.0 | 7.0 | 45 | 720 | 15 | 5.0 | 80 | 220 |
| DAO | 84 | 6.0 | 13.0 | liquid[a] | 133 | 0.3 | 4.2 | 30 | 90 |
| Asphalt | 16 | 49 | −6 | 180 | solid | 89.5 | 7.5 | 378 | 919 |

EXAMPLE 4

Orinoco super-heavy oil from Venezuela has a boiling point above 350° C. and a density at 20° C. greater than 1.0 g/cm$^3$. A two-stage extraction was used for this material and the process was the same as in Example 1. The compositions of the solvent are as follows:

| Component | Isobutane | butane | pentane | hexane |
|---|---|---|---|---|
| Composition, mol % | 1.00 | 0.05 | 78.05 | 20.90 |
| Critical Temp., ° C. | 135.0 | 152.0 | 196.6 | 234.4 |

The pseudo critical temperature of the mixed solvent was 203.9° C.

The flow rate of the feedstock was 100 kg/h with a primary solvent to oil ratio of 4:1 and a secondary solvent to oil ratio of 0.5:1. The extraction column was at 165° C. and 4 MPa. The asphalt obtained had a softening point of 160° C.

The asphalt phase and the enhanced dispersing solvent were mixed with a solvent to asphalt mass flow ratio of 0.12:1. The asphalt and the solvent were separated at atmospheric pressure by rapid phase change. The asphalt particles were 80 μm in diameter on average of which 58% were smaller than 80 μm with a residual solvent content of 0.20 wt % of the mass of the asphalt particles. The asphalt particles can be used as slurry fuel by adding water.

The solvent density in the supercritical solvent recovery column 06 was 0.18 g/cm$^3$. More than 80% of the solvent used was separated and recovered. The yield of the DAO was 80%. The viscosity was only 1/14 of the feedstock and the removal of Ni and V were 81.2% and 89.4%, respectively, which is favorable for transportation and further deep upgrading.

The yield and properties of the feedstock and the products are listed in the table below:

| | Yield wt % | API | Softening Point ° C. | Viscosity (100° C.) mPa.s | C7 Asp. wt % | Elemental content S wt % | Ni μg/g | V μg/g |
|---|---|---|---|---|---|---|---|---|
| Feedstock | 100 | 8.9 | 45 | 800 | 16 | 3.6 | 85 | 318 |
| DAO | 80 | 12.5 | liquid[a] | 55 | <0.1 | 3.4 | 20 | 42 |
| Asphalt | 20 | −6.0 | 160 | solid | 80 | 4.6 | 420 | 1424 |

EXAMPLE 5

Vacuum residue from Canadian Athabasca oil sand bitumen with a boiling point of over 524° C., density of 1.0596 g/cm$^3$ at 20° C. and C7 asphaltene of 18.1 wt % was obtained from a commercial oil sand plant. A two-stage extraction was used for this feedstock with pentane blended as the solvent. The composition of the solvent and the process were the same as in Example 1. The flow rate of feedstock was 100 kg/h with a primary solvent to oil ratio of 4:1 and a secondary solvent to oil ratio of 0.5:1. The extraction column was at 180° C. and 7 MPa. The softening point of the asphalt obtained was 150° C.

The asphalt phase and the enhanced dispersing solvent were mixed with a solvent to asphalt mass flow ratio of 0.25:1. The mixture then entered gas-solid separator 07 and the asphalt and the solvent were separated at atmospheric pressure by rapid phase change. The asphalt particles were 100 μm in diameter on average of which 56% was smaller than 100 μm with a residual solvent of 0.25 wt % of the mass of the asphalt particles. The yield of DAO was 61.88 wt % with all the C7 asphaltene removed. The removal of Ni, V and carbon residue were 76.7%, 81.1% and 70.6%, respectively. The solvent density in the supercritical solvent recovery column 06 was 0.200 g/cm$^3$. More than 80.5% of solvent used was separated and recovered.

The yields and properties of the feedstock and the products are listed in the table below:

| | Yield wt % | Carbon Residue wt % | Density (20° C.) g/cm$^3$ | Softening Point ° C. | C7 Asp. wt % | Elemental content N wt % | S wt % | Ni μg/g | V μg/g |
|---|---|---|---|---|---|---|---|---|---|
| Feedstock | 100 | 24.9 | 1.0596 | 80 | 18.1 | 0.63 | 6.05 | 104 | 280 |
| DAO | 61.88 | 11.85 | 0.9990 | liquid[a] | 0.2 | 0.50 | 4.89 | 39.1 | 85.4 |
| Asphalt | 38.12 | 42.6 | 1.0600 | 150 | 58.4 | 1.06 | 7.74 | 293 | 746 |

EXAMPLE 6

The properties and the source of this feedstock was the same as in Example 5. A three-stage extraction separation was used for this sample and the procedure was the same as in Example 2. The solvent was hexane with a critical temperature of 222° C. The flow rate of feedstock was 100 kg/h with a primary solvent to oil ratio of 4:1 and a secondary solvent to oil ratio of 0.5:1. The extraction column was at 190° C. and 4 MPa. The softening point of the asphalt was controlled to above 200° C.

The asphalt phase and the enhanced dispersing solvent were mixed with a solvent to asphalt mass flow ratio of 0.15:1. The mixture then entered gas-solid separator and the asphalt and the solvent were separated at atmospheric pressure by rapid phase change. The asphalt particles were 60 μm in diameter on average of which 78% smaller than 60 μm with a residual solvent of 0.30 wt % of the mass of asphalt particles.

The DAO phase discharged from the extraction column was mixed with the supercritical solvent from supercritical solvent recovery column 06 in mixer 03 and then entered resin separation column 04. The ratio of mass flow of supercritical solvent to the total mass flow of DAO was 0.2:1 while the ratio of mass flow of the resin-free light DAO phase from the bottom of the supercritical solvent recovery column to the mass flow of total DAO phase from the top of extractor was 0.15:1. The resin phase was separated from the light DAO phase in the resin Separation column 04 with light DAO and resin yields of 69.7% and 12.8%, respectively. Compared with Example 3, the total yield for both light DAO and resin was 83.5%.

The solvent density in supercritical solvent recovery column 06 was 0.17 g/cm$^3$. More than 80% of the total solvent used was separated and recovered. Ni and V in DAO accounted for only 32.8% and 23.3% of that in the feedstock. 44.5% Ni, 55.9% V and 47.9% carbon residue were removed from the feedstock with the asphalt. In addition, the DAO did not contain asphaltene.

The yields and properties of the feedstock and the products are listed in the table below:

| | Yield wt % | Carbon Residue wt % | Density (20 ° C.) g/cm$^3$ | Softening Point ° C. | C7 Asp. wt % | Elemental content N wt % | S wt % | Ni μg/g | V μg/g |
|---|---|---|---|---|---|---|---|---|---|
| Feedstock | 100 | 24.9 | 1.0596 | 80 | 18.1 | 0.63 | 6.05 | 104 | 280 |
| DAO | 69.7 | 11.7 | 0.9964 | liquid[a] | 0.5 | 0.4 | 4.94 | 49.0 | 94.0 |
| Resin | 13.8 | 35.0 | 1.0154 | 42 | 5.9 | 0.98 | 6.46 | 171 | 421 |
| Asp. | 16.5 | 56.0 | 1.0890 | >200 | 85.4 | 1.1 | 7.80 | 310 | 750 |

EXAMPLE 7

The vacuum residue from Canadian Cold Lake heavy oil was obtained from a Canadian commercial refinery, which has a boiling point of over 524° C., density of 1.0402 g/cm$^3$ at 20° C., softening point of 73° C. and C7 asphaltene content of 17.73 wt %. A three-stage extraction separation was used for this feedstock and the procedure was the same as in Example 2. The solvent was pentane. The flow rate of feedstock was 100 kg/h with a primary solvent to oil ratio of 4:1 and a secondary solvent to oil ratio of 0.5:1. The extraction column was at 185° C. and 6 MPa. The softening point of the asphalt was controlled to be above 180° C.

The asphalt phase and the enhanced dispersing solvent were mixed with a solvent to asphalt mass flow ratio of 0.15:1. The mixture then entered gas-solid separator 07 and the asphalt and the solvent were separated at atmospheric pressure by rapid phase change. The asphalt particles were 65 μm in diameter on average of which 72% were smaller than 65 μm with residual solvent of 0.28 wt % of the mass of the asphalt particles. The particles can be used as slurry fuel by adding water.

The DAO phase discharged from the extraction column was mixed with supercritical solvent in mixer 03. The ratio of mass flow of supercritical solvent mixed to the total mass flow of DAO from the extractor was 0.10:1, while the ratio of mass flow of the resin-free light DAO phase from the bottom of the supercritical solvent recovery column to the mass flow of total DAO phase was 0.15:1. The resin phase was separated from the light DAO phase in the resin separation column 04. The DAO phase was heated to a higher temperature and was further separated as light DAO and resin with yields of 70.2% and 8.5%, respectively. The solvent density in supercritical solvent recovery column 06 was 0.195 g/cm$^3$. More than 80% of the solvent used was separated and recovered. The content of carbon residue and Ni, V of DAO were 46.9%, 49% and 35.9% of the feedstock, respectively. The removal of C7 asphaltene and carbon residue with asphalt were 90.8% and 54.3%, respectively. The removal of Ni and V with the asphalt were 48.0% and 57.0%, respectively.

The yields and properties of the feedstock and the products are listed in the table below:

| | Yield wt % | Carbon Residue wt % | Density (20° C.) g/cm$^3$ | Softening Point ° C. | C7 Asp., wt% | Elemental content S wt% | Ni μg/g | V μg/g |
|---|---|---|---|---|---|---|---|---|
| Feedstock | 100 | 24.5 | 1.0402 | 73 | 17.73 | 5.64 | 129.8 | 287.1 |
| DAO | 70.2 | 11.5 | 0.9980 | liquid[a] | 0.3 | 4.74 | 63.6 | 103 |
| Resin | 8.5 | 32.5 | 1.0310 | 35 | 4.5 | 5.90 | 150 | 310 |
| Asphalt | 21.3 | 60.0 | 1.1009 | 180 | 83.5 | 7.5 | 340 | 875 |

That which is claimed:

1. A method for deep separation of a heavy oil with coupled post-extraction adjustable asphalt residue granulation, comprising the steps of:

a) mixing, and feeding heavy oil feedstock and an extraction solvent into an extraction column, with a mass flow ratio of the extraction solvent and the heavy oil feedstock of 1.5 to 5.0:1;

b) separating an asphalt-free oil phase from an asphalt phase in the extraction column by extraction, and discharging the asphalt-free oil phase from a top of the extraction column;

c) introducing an additional amount of the extraction solvent to the asphalt phase in the extraction column, through a solvent inlet at a lower part of the extraction column, with a mass flow ratio of the extraction solvent and the heavy oil feedstock of approximately 0.2-2:1, and performing a further extraction of oil in the asphalt phase;

d) discharging the asphalt phase, after completing the further extraction, out of the extraction column through an asphalt outlet at a bottom of the extraction column;

e) adding a dispersing solvent consisting essentially of alkanes to discharged asphalt phase, through a dispersing solvent inlet of a gas-solid separator, at a mass flow ratio of the dispersing solvent to the asphalt phase of approximately 0.01-0.5:1 to form a dispersed asphalt phase, wherein an amount and condition of the dispersing solvent control asphalt granulation;

f) carrying out gas-solid phase change separation on the dispersed asphalt phase in the gas-solid separator at a temperature above the boiling point of the dispersing solvent but below the softening point of asphalt, whereby the dispersing solvent becomes gaseous and the asphalt is dispersed into solid particles; formed solid asphalt particles having size thereof depending on the amount of the dispersing solvent added in step (e); and g) recovering vaporized dispersing solvent by condensation.

2. The method according to claim 1, wherein the dispersing solvent is the same as the extraction solvent.

3. The method according to claim 1, wherein in step (a):

said separating an asphalt-free oil phase from an asphalt phase is carried out in the extraction column at a temperature of approximately 80 ° C.-250 ° C. and a pressure of approximately 3-10 MPa.

4. The method according to claim 1, further comprising the steps of:

h) mixing the asphalt-free oil phase obtained from step (b) with a supercritical solvent, with a mass flow ratio of the supercritical solvent to the asphalt-free oil phase of approximately 0.01-0.5:1;

i) passing formed mixture of the asphalt-free oil phase and the supercritical solvent in a resin separation column through a countercurrent flow of a resin-free oil phase which has a higher temperature, through a temperature gradient inside the resin separation column, with a mass flow ratio of the resin-free oil phase to the mixture of the asphalt-free oil phase and the supercritical solvent of approximately 0.01-0.5:1, and obtaining separated resin and a light deasphalted oil containing the supercritical solvent, respectively; and j) delivering the light deasphalted oil obtained in step (i) into a supercritical solvent recovery column and heating the light deasphalted oil therein to put the supercritical solvent in a supercritical state, thereby achieving separation of the supercritical solvent from the light deasphalted oil.

5. The method according to claim 4, wherein the resin-free oil phase is a light deasphalted oil produced in the supercritical solvent recovery column.

6. The method according to claim 5, wherein the light deasphalted oil is heated so that the supercritical solvent is kept at the supercritical state and the density of the supercritical solvent is equal to or lower than 0.2 g/cm$^3$.

7. The method according to claim 1, wherein principal components of the extraction solvent are C4-C6 alkane fractions having a pseudo-critical temperature approximately between 120° C. and 240° C., the pseudo-critical temperature being calculated using equation:

$$Tc = \sum_{i=1}^{n} x_i Tc_i,$$

where $x_i$ is the molar fraction of solvent component i, $Tc_i$ is the critical temperature of the component i in Celsius, and n is the number of components contained in the extraction solvent.

8. The method according to claim 1, wherein the softening point of the asphalt is approximately above 100° C.

9. The method according to claim 3, wherein the temperature of the extraction column is approximately from 120° C. to 200° C.

10. The method according to claim 1, wherein the extraction solvent and the dispersing solvent are utilized in a circulation manner.

11. The method according to claim 1, wherein the heavy oil feedstock comprises heavy oil, oil sand bitumen recovered from an oil field, or residuum from a processing unit with a density at 20° C. greater than 0.934 g/cm$^3$ or a boiling point above 350° C.

12. The method according to claim 4, further comprising recovering remaining solvent in the light deasphalted oil and the resin, respectively, by pressure reduction, heating, and stripping.

13. The method according to claim 1, wherein the size of said solid asphalt particles is adjusted by controlling the amount of the dispersing solvent.

14. The method according to claim 4, wherein the resin-free oil phase having a higher temperature is sprayed downward on the mixture of the asphalt-free oil phase and the supercritical solvent, thereby establishing the temperature gradient with an increase of temperature in upward direction.

* * * * *